United States Patent [19]

Cantley

[11] 3,970,010

[45] July 20, 1976

[54] SAFE DEPOSIT BOX SYSTEM

[76] Inventor: Ross H. Cantley, 577 Essex Road, Beaconsfield, Quebec, Canada

[22] Filed: Mar. 20, 1974

[21] Appl. No.: 453,088

[52] U.S. Cl. ..... 109/56; 70/85; 109/47; 312/298; 312/301; 312/311

[51] Int. Cl.[2] ..... A45C 1/12; A47B 88/20; E05B 65/46; E05G 1/08

[58] Field of Search ..... 70/85; 109/47, 53, 56; 312/294, 295, 335, 219, 298, 301, 311

[56] References Cited

UNITED STATES PATENTS

| | | | |
|---|---|---|---|
| 181,963 | 9/1876 | Miles | 312/301 X |
| 400,499 | 4/1889 | Siersdorfer | 109/47 |
| 827,649 | 7/1906 | Murphy | 312/301 |
| 1,171,185 | 2/1916 | Fox | 312/219 |
| 1,330,936 | 2/1920 | Erickson | 70/85 X |
| 1,440,484 | 1/1923 | Mooney | 109/47 X |
| 1,486,176 | 3/1924 | Wolters | 109/47 X |
| 1,750,291 | 3/1930 | Whetstone | 312/340 |
| 1,992,106 | 2/1935 | Wee | 312/301 X |
| 2,775,947 | 1/1957 | Mosler | 109/47 |

*Primary Examiner*—Paul R. Gilliam
*Assistant Examiner*—Carl F. Pietruszka
*Attorney, Agent, or Firm*—Diller, Brown, Ramik & Wight

[57] ABSTRACT

A security storage system comprising a security storage chest having a lock and a compartmented frame. The frame is slidably mounted in the chest to move in or out in a straight line. Access to the compartments is from the side of the frame in a direction substantially perpendicular to the direction of movement of the frame. Each compartment holds a security storage box. Each box has a construction permitting it to be locked into the frame.

3 Claims, 4 Drawing Figures

SAFE DEPOSIT BOX SYSTEM

BACKGROUND OF THE INVENTION

1. Field of the Invention

This invention is directed toward an improved, safe security storage system. The invention is also directed toward an improved, safe storage box, which is particularly adapted for use with the improved security storage system.

2. Description of the Prior Art

Security storage systems now usually employed by security institutions, such as banks, for example, for customer use, comprise a security room having compartments defined in a frame along a wall. Each compartment holds a safe deposit or storage box which is rented by a customer. Each compartment is closed by a heat resistant door hinged to the frame, which door usually has a double lock. The security institution has a key which activates the lock, and the customer has a key to complete the opening of the lock. In addition, the security room itself can have locked doors.

The compartmented safe deposit boxes require an amount of exposed accessible space which is economically imbalanced relative to other uses that the same space can be put to. It has also been found that conventional security storage systems are relatively accessible to burglars who may have penetrated the security room since the individual compartment doors are exposed.

SUMMARY OF THE INVENTION

It is the purpose of the present invention to provide a security storage system, and safe storage boxes for use in the system, which will be safer and which can be effectively and economically used in locations where space requirements are a critical factor.

The security storage system basically comprises a storage chest having an exterior locked door and a compartmented frame stored in the chest. Each compartment can carry a storage box and means are provided for locking each box in its compartment. The frame is movable out of the chest to provide access to the compartments.

Such systems are known as shown in U.S. Pat. 2,775,947, issued Jan. 1, 1957, A. R. Mosler. The system shown in this patent, however, has certain disadvantages compared to the present system. The mounting of the compartmented frames is quite complicated and thus relatively expensive. In addition, the mounting system does not lend itself to using space in the chest efficiently. More importantly, a master lock provides access to all the compartments in a frame. This reduces the security provided when the system is rented to customers.

It is, therefore, the purpose of the present invention to provide a security storage system of the type using a storage chest, with a plurality of safe storage boxes carried in a compartmented frame, and which frame can be moved into and out of the storage chest, which system avoids or minimizes the disadvantages of known systems. In the system of the present invention, the frame is arranged and mounted within the chest in a manner to maximize the use of the space within the chest. In addition, means are provided for locking the safe storage boxes in the frame in a simple but secure manner.

The invention, in one embodiment, is directed toward a safe storage system which has a safe storage chest, a closure on the storage chest, providing access to the interior of the chest and means for locking the closure. The system also has a frame providing elongated compartments. Means are provided for slidably mounting the frame in the chest for movement out of, or into, the chest in a substantially straight line.

The compartments in the frame preferably extend in a direction substantially perpendicular to the direction of movement of the frame into or out of the chest, and access to the compartments is from the side of the frame.

Each compartment can carry a safe storage box. Each storage box carries locking means for locking it in the compartment, the locking means cooperating with a portion of the frame.

The invention is also directed toward a safe storage box which comprises an elongated walled container open at the top. A cover closes the top of the container. The cover extends past one end of the container and the extension carries locking means for use in locking the box in a box holder.

BRIEF DESCRIPTION OF THE DRAWINGS

The invention will now be described in detail having reference to the accompanying drawings, in which.

DESCRIPTION OF THE PREFERRED EMBODIMENTS

Figure 1:
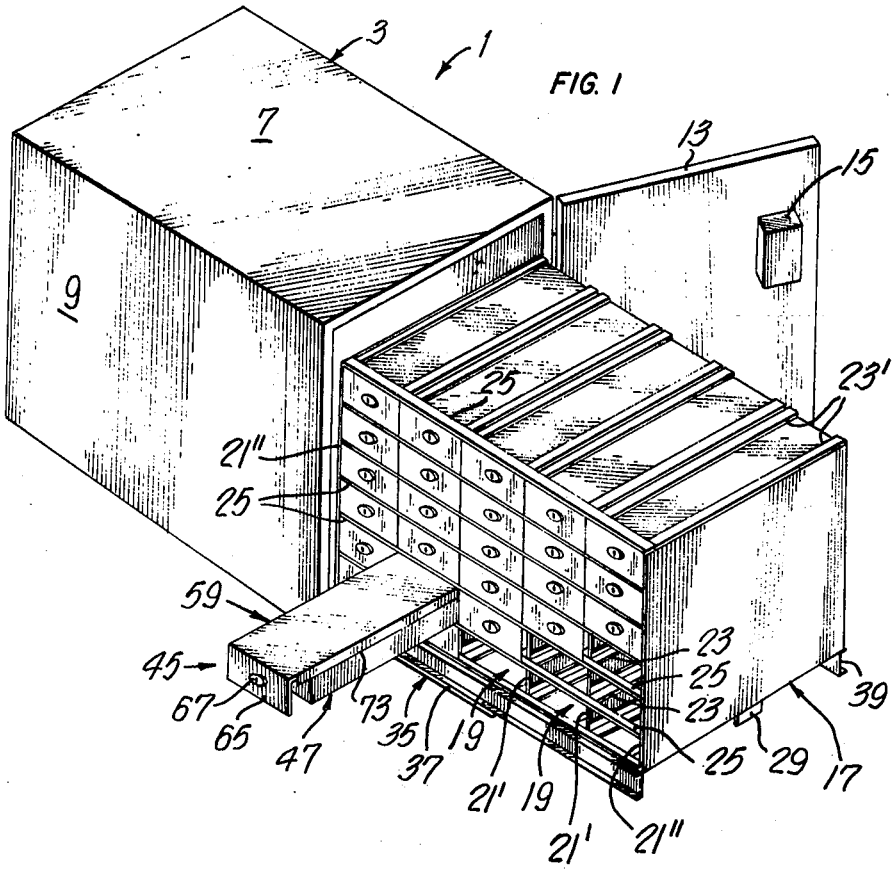
FIG. 1 is a schematic view of the safe storage system.
Figure 2:
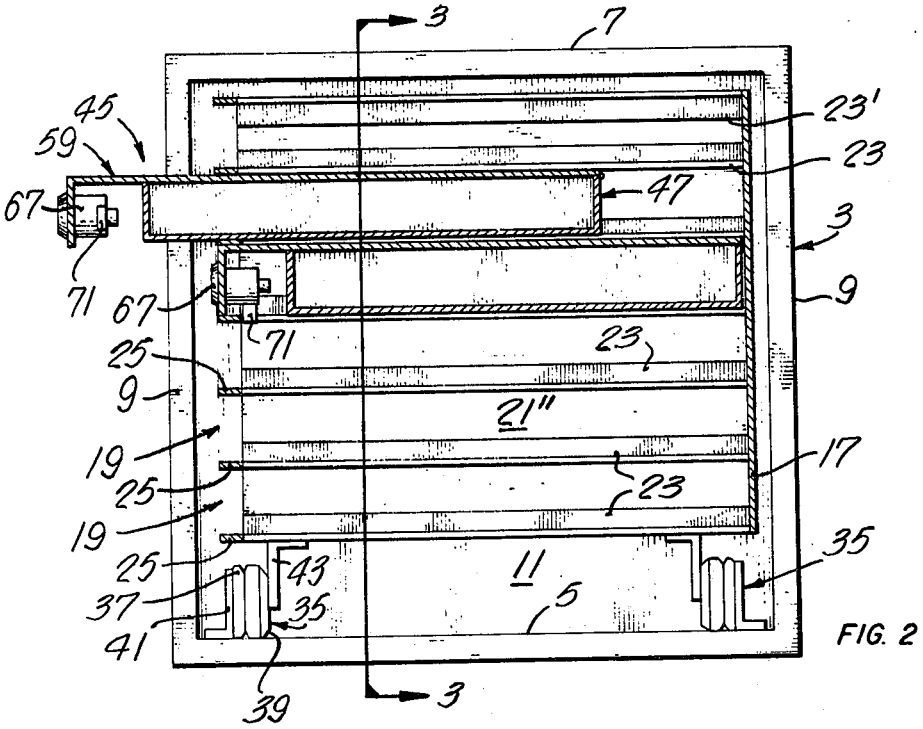
FIG. 2 is a transverse cross-sectional view of the safe storage system taken along line 2—2 of FIG. 3 showing only two storage boxes.
Figure 3:
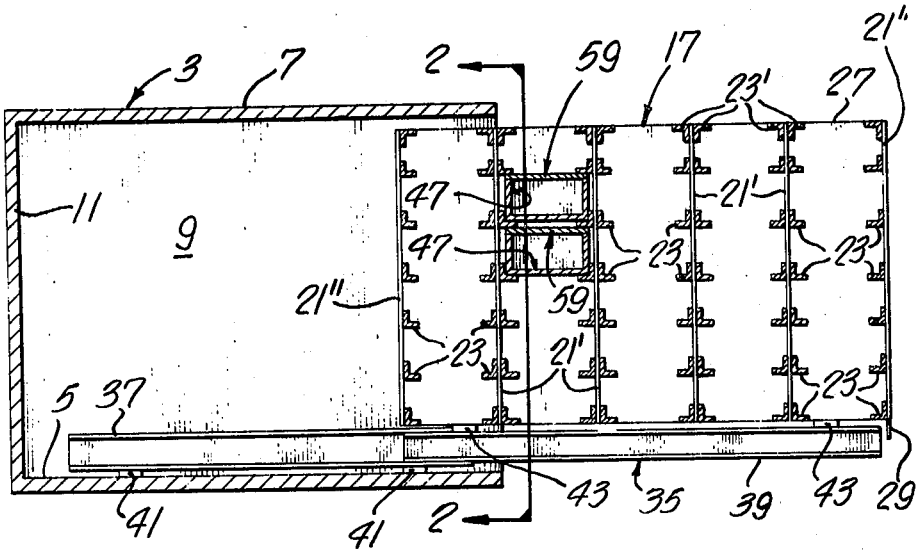
FIG. 3 is a longitudinal cross-sectional view of the safe storage system taken along line 3—3 of FIG. 2.

As shown in FIGS. 1, 2 and 3, the safe storage system 1 of the present invention includes a strong storage chest 3. The chest is preferably rectangular in shape and made of suitable material which is heat resistant and which makes forcible entry difficult. The chest 3 has a bottom wall 5, a top wall 7, side walls 9 and a back end wall 11. The front end of the chest is open. This front open end is closed by a door 13 hinged to one of the side walls 9 by suitable hinge means. The door 13 has locking means 15 to lock the door when in a closed position.

The system 1 further includes a rectangular frame 17 defining a plurality of elongated pigeon holes or compartments 19. The frame 17 is sized to substantially fill the interior space in the chest. Access to the compartments is from a side of the frame. The frame 17 is made of equally horizontally spaced-apart vertical partitions 21. The partitions extend transversely of the frame. Each partition 21 carries a plurality of equally vertically spaced-apart horizontal supports 23. The interior partitions 21′ have the supports on either side. The exterior or end partitions 21″ have the supports on the inner side only. The top and bottom of the frame can be left open. A top wall 23′ is provided at the top of the partitions 21 to close the top compartments. The supports 23 form shelves for carrying safe storage boxes as will be described. The frame 17 has a plurality of longitudinally extending, horizontal bars 25, equally vertically spaced, attached to one side of the partitions 21. The bars 25 and the front of the partitions 21 form the openings to the compartments 19 on the one side of the frame. The other side of the frame is closed by a wall 27. While in this embodiment, all the compartments open to the same side, some frames could be arranged to open from either side thus providing access to some compartments from one side and to other compartments from the other side of the frame. A handle 29 is provided at the bottom of the front of the frame.

The frame 17 is mounted on suitable, slidable, mounting means 35 so that it can slide in or out horizontally of the chest 3 when the chest is open. The mounting means 35 can comprise means similar or identical to those well known for mounting file cabinet drawers. These means generally comprise a pair of telescoped lever arms 37, 39 on each bottom side of the frame. These arms slide relative to one another and also relative to the chest to support the frame in cantilevered fashion as is well known. The arms 37 are mounted to the chest 3 by suitable brackets 41 and to the frame 17 by suitable brackets 43 as is well known.

Figure 4:
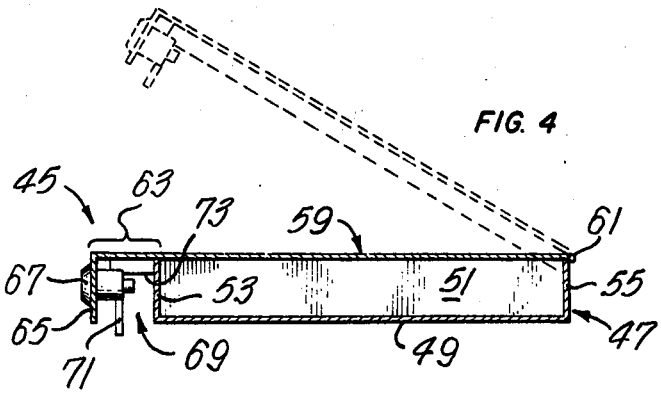
FIG. 4 is a longitudinal cross-sectional view of one of the safe storage boxes.

A safe storage box 45 can be mounted within each compartment 19. Each storage box 45 comprises an open container 47 as shown in FIG. 4. Each container 47 has a bottom wall 49, side walls 51, a front wall 53 and a back wall 55.

Container 47 is closed by a cover 59 which is hinged, by suitable hinge means 61, to the back wall 55. The cover 59 pivots up, as shown by the dotted lines in FIG. 4, to provide entry into container 47. The cover 59 preferably has an extension section 63 as shown by the bracket in FIG. 4, so that the cover extends past the front wall of the container. The extension section 63 carries a front panel 65 which is spaced from but substantially parallel to the front wall 53. The panel 65 carries a lock 67 which projects into space 69 located between the panel 65 and the front wall 53. The lock is preferably of the type having a locking bar 71 which in the locked position of the lock extends from space 69 below the bottom wall 49 of the container. The cover 59 can be provided with partial side walls 73 to overlap the side walls 51 of the container to more completely close the container.

Each safe storage box 45 slides into one of the compartments or pigeon holes 19, supported by angle supports 23 on the adjacent partitions 21. When lock 67 is then operated, locking bar 71 is moved to extend down past the horizontal front bar 25, the box moved over as shown in FIG. 2. This then prevents the box from being withdrawn until the lock 67 is unlocked moving bar 71 up past bar 25 into space 69.

The frame 17 is slid into or out of the chest 3 in a straight line by grasping the handle 29 and pulling or pushing the frame relative to the chest when the chest door 13 is open. It will be noted that the compartments 19 are elongated in a direction which is substantially perpendicular to the direction of movement of the frame in or out of the chest. The chest can, therefore, be made quite long and the storage boxes which go into the compartments can be made relatively short. Yet the entire interior space of the chest can be utilized because the frame slides wholly out of the chest providing access to all the boxes.

It is seen that groups of safe deposit boxes can be provided in a very small space which makes the system quite adaptable to or within all types of security vaults utilized in banks, trust companies, credit unions etc. Maximum utilization is made of the space employed. While the drawings and description show a chest holding a single frame, chests can be employed which could hold two or more frames, with either one door on the chest providing access to all the frames or a separate door, and lock, for each frame.

I claim:

1. A safe deposit box storage system comprising a storage housing having bottom, inner, side, top and rear walls defining a predetermined space having an open front of a predetermined width and a height, a frame defining compartments, the frame having dimensions such that it closely fits within the predetermined space and including a depth materially exceeding the width of said open front with the number of said compartments materially exceeding that accommodatable within said open front, track means for mounting the frame in the housing for sliding movement into and out of the housing through said open front, said track means including a pair of parallel slide members, one mounted to each side wall and to the sides of the frame, such that the frame may be slid out in line from a position completely within the confines of the housing, the frame comprising a plurality of vertical and horizontal partitions defining said compartments, said compartments extending substantially perpendicular to the direction of movement of the frame into and out of the housing and access to the compartments being from the side of the frame, a safe storage box for mounting snugly in each compartment, each safe storage box including an elongated open walled container, a cover hinged to the container, the cover extending past one end of the container and having a flanged extension flush with the side of the frame and closing the opening to the respective compartment, the flanged extension of the cover carrying locking means for use in locking the storage box to a partition forming each compartment to lock the box in the frame, and means for locking said frame within the housing for preventing access to said safe storage.

2. A safe storage system as claimed in claim 1, wherein the locking means ocmprises a lock having a rotatable finger, the finger rotatable between a position located above the bottom of the container in the space between the front panel and the front wall and a position extending below the bottom of the container.

3. A safe storage system according to claim 1 wherein the means for locking said frame in said housing includes a closure associated with said housing and means for locking said closure to said housing.

* * * * *